US007589674B2

(12) United States Patent
Anagnostou et al.

(10) Patent No.: US 7,589,674 B2
(45) Date of Patent: Sep. 15, 2009

(54) RECONFIGURABLE MULTIFREQUENCY ANTENNA WITH RF-MEMS SWITCHES

(75) Inventors: Dimitrios Anagnostou, Albuquerque, NM (US); Guizhen Zheng, Albuquerque, NM (US); Ioannis Papapolymerou, Albuquerque, NM (US); Christos Christodoulou, Albuquerque, NM (US)

(73) Assignee: STC.UNM, Albuquerque, NM (US)

( * ) Notice: Subject to any disclaimer, the term of this patent is extended or adjusted under 35 U.S.C. 154(b) by 461 days.

(21) Appl. No.: 11/488,142

(22) Filed: Jul. 18, 2006

(65) Prior Publication Data

US 2009/0207091 A1 Aug. 20, 2009

Related U.S. Application Data

(60) Provisional application No. 60/702,281, filed on Jul. 26, 2005.

(51) Int. Cl.
*H01Q 1/38* (2006.01)

(52) U.S. Cl. ..... 343/700 MS; 343/795

(58) Field of Classification Search ..... 343/700 MS, 343/909, 846, 795
See application file for complete search history.

(56) References Cited

U.S. PATENT DOCUMENTS

| | | | | |
|---|---|---|---|---|
| 6,762,719 | B2 * | 7/2004 | Subotic et al. | 342/374 |
| 2003/0052818 | A1 * | 3/2003 | Subotic et al. | 342/374 |
| 2005/0259004 | A1 * | 11/2005 | Subotic et al. | 342/368 |

* cited by examiner

*Primary Examiner*—HoangAnh T Le
(74) *Attorney, Agent, or Firm*—MH2 Technology Law Group LLP

(57) ABSTRACT

A self-similar multiband reconfigurable antenna includes a planar antenna structure formed on a surface of a substrate, the antenna structure including symmetrically opposed self-similar geometry antenna arms defining a self-similar or Sierpinski gasket configuration for each arm of the antenna. MEMS type switches are provided for operatively connecting adjacent antenna patches on each arm of the antenna configuration, and a voltage source is provided for selectively actuating the switches. Selective actuation of the switches enables up to four different antenna configurations each having a different resonant frequency, and wherein each resonant frequency demonstrates a similar radiation pattern.

34 Claims, 5 Drawing Sheets

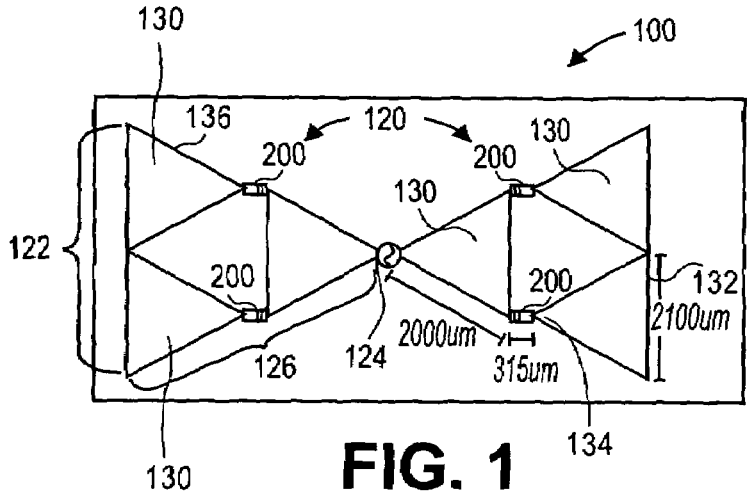
FIG. 1
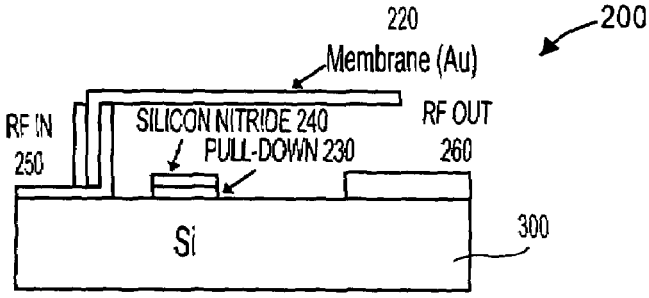
FIG. 2
FIG. 3
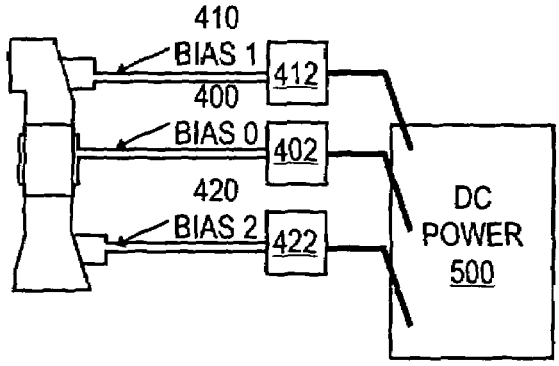

RECONFIGURABLE MULTIFREQUENCY ANTENNA WITH RF-MEMS SWITCHES

CROSS-REFERENCE TO RELATED APPLICATIONS

This application claims the benefit of U.S. Provisional Application No. 60/702,281 filed on Jul. 26, 2005, which is incorporated herein by reference in its entirety.

GOVERNMENT RIGHTS

This invention was made with Government support under Contract No. F29601-00-C-0244 awarded by the Air Force Materiel Command/Space Electronics Modeling, Development and Experimentation and under Contract No. ECS0218732 awarded by the National Science Foundation. The government has certain rights in the invention.

FIELD OF THE INVENTION

The present invention generally relates to a reconfigurable antenna, and, more particularly to a reconfigurable antenna incorporating a self-similar planar antenna and radio frequency micro-electromechanical (RF-MEMS) switches, the reconfigurable antenna radiating on demand at three frequencies.

BACKGROUND OF THE INVENTION

Modern communication systems demand multiband antenna performance. An apparatus to address this need is by using reconfigurable antennas. Reconfigurable antennas are known. However, an increasing demand for reconfigurable systems, which are also versatile, has not yet been satisfactorily addressed. In particular, there is a need to provide a reconfigurable antenna operable at multiple frequencies. At the present time, multiple frequencies are obtained by utilizing PIN diodes or many different antennas in order to have an antenna for each desired frequency. Another approach has been to reconfigure antennas, particularly the reconfigurable aperture (recap) antenna with micro-electromechanical (MEMS) switches, which has been unsuccessful, and microstrip antennas using PIN diodes, with some success. Still another approach includes the use of known "Sierpinski" type multiband antennas. However, the known Sierpinski type antennas only radiate at a number of frequencies, related to the number of iterations of the Sierpinski structure. Accordingly, even with these reconfigurable antennas, there is no provision for an antenna including on-demand selection of one of three predetermined frequencies.

An integration of RF-MEMS switches into known antenna systems has been attempted; however, an integration of RF-MEMS switches with the antenna has not been satisfactorily achieved. Moreover, no multiband antenna has been shown or reported to be RF-MEMS reconfigurable. In particular, there continue to be problems overcoming the effect of switch bias lines on the antenna performance. The bias lines of the RF-MEMS switches have been found to problematically affect the radiation pattern of the antenna, as well as its resonant frequencies.

Furthermore, recovery from these problems can be difficult. For example, the continued miniaturization of antennas and their parts prevents spacing of bias lines at intervals which will not interfere with the radiation patterns of the antenna. One reason for the desired use of MEMS switches resides in their lower insertion loss, lower power requirements, higher linearity, reliability, and better isolation effects than any other biasing method such as, for example, PIN/FET. However, incorporation of these switches into an antenna configuration has not previously been successful because of the inability to bias them and place them in a way to not affect antenna performance. Disadvantages include their long switching times (on the order of 1-20 μs), high actuation voltage and they are unable to handle high-power RF applications.

Thus, there is a need to overcome these and other problems of the prior art and to provide a reconfigurable multifrequency antenna with RF-MEMS switches. The present invention successfully integrates RF-MEMS switches with compatible antenna structures in a very efficient way that enhances the performance of the conventional antenna by adding an additional resonant frequency without altering its radiation pattern.

SUMMARY

Accordingly, embodiments of the present invention are generally directed to a reconfigurable multifrequency self-similar planar antenna incorporating MEMS switches. In other words, the antenna is reconfigurable while maintaining similar patterns at different frequencies and radiates on demand at selected widely spaced frequencies.

In accordance with one embodiment, this constitutes a great advancement considering that with conventional antenna structures, sidelobes cannot be avoided at their higher modes of operation. A reconfigurable antenna system includes a substrate, and an antenna patch on the surface of the substrate. The antenna patch includes symmetrically opposed fractal geometry metallic patches defining a Sierpinski configuration. Switches operatively connect adjacent antenna patches on each arm of the Sierpinski configuration, and a power source is provided for selectively actuating the switches.

In accordance with the present teachings, a method of fabricating an RF-MEMS-based self-similar reconfigurable antenna comprises forming a substrate of a high resistivity material, forming a bow-tie antenna on a surface of the substrate, the bow-tie antenna including the symmetrically opposed patches forms the Sierpinski gasket configuration of the first iteration, operatively connecting adjacent antenna patches on each arm of the Sierpinski configuration with an RF-MEMS switch, and selectively actuating the switches with a voltage source of 40 Volts.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

The accompanying drawings, which are incorporated in and constitute a part of this specification, illustrate several embodiments of the invention and together with the description, serve to explain the principles of the invention.

BRIEF DESCRIPTION OF THE DRAWINGS

FIG. 1 is top schematic view depicting an exemplary reconfigurable antenna in accordance with embodiments of the present teachings.

FIG. 2 is a side schematic view of a switch used in the reconfigurable antenna of FIG. 1 in accordance with embodiments of the present teachings.

FIG. 3 is top schematic view of the switch and associated bias lines in accordance with embodiments of the present teachings.

DESCRIPTION OF THE EMBODIMENTS

Figure 4:
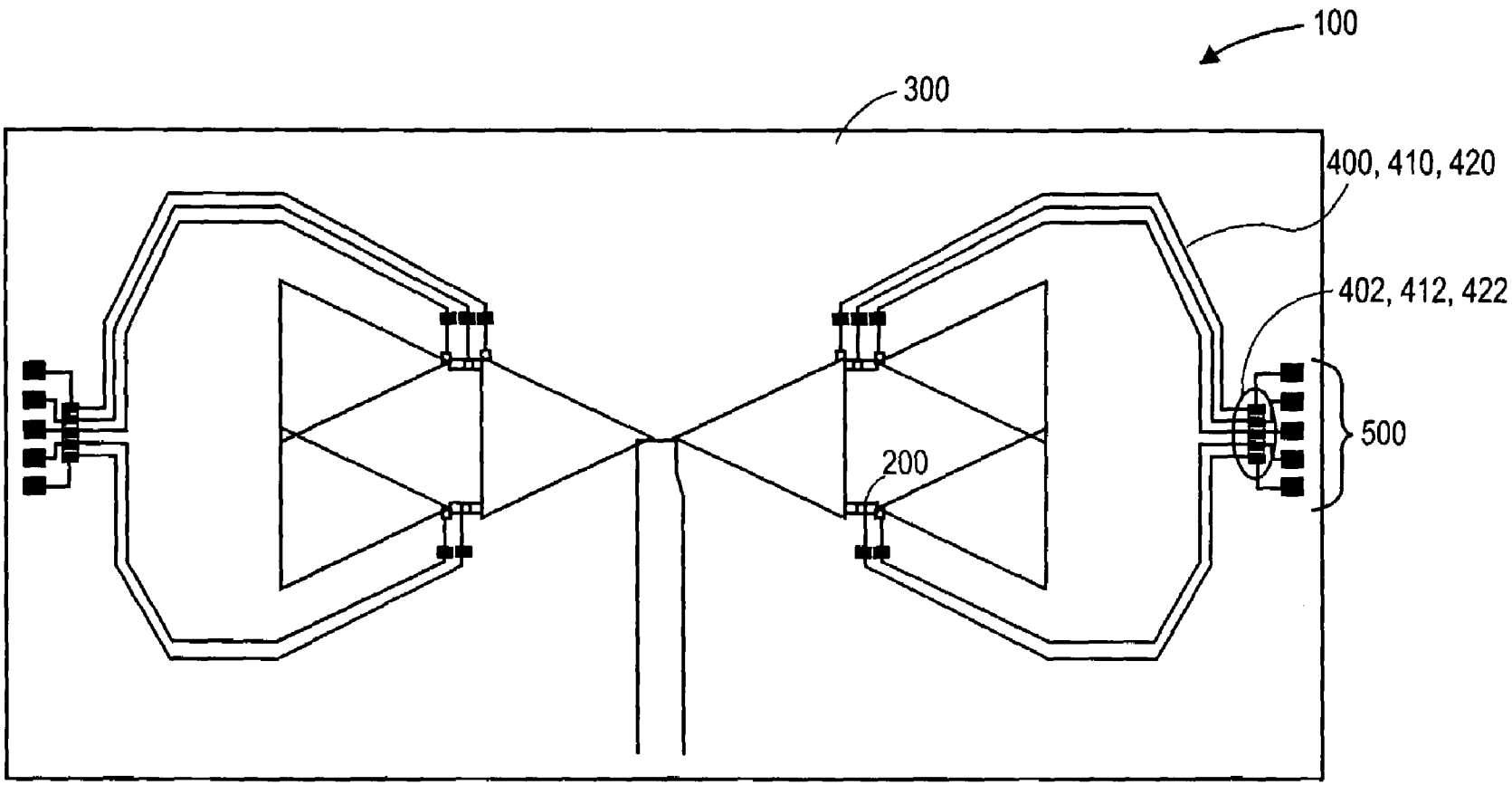
FIG. 4 is a diagrammatic view illustrating an antenna layout including a bias network in connection with the exemplary antenna.

Reference will now be made in detail to exemplary embodiments of the invention, examples of which are illustrated in the accompanying drawings. Wherever possible, the same reference numbers will be used throughout the drawings to refer to the same or like parts.

The following description of various exemplary embodiments including a self-similar fractal antenna configuration and a plurality of switches in a combination that yields a reconfigurable antenna that selectively radiates on demand at one of three different frequencies. The frequencies may be slightly varied according to a change in a bow-tie angle of the fractal antenna, but the length of each triangular patch is what affects the frequency the most.

The exemplary embodiments described herein are equally applicable to systems having more than one antenna iteration and various fractal self-similar configurations other than those described. In each instance, it will be appreciated that the outcome of a reconfigurable antenna operable on demand at a selected one of multiple frequencies will be obtained.

Various exemplary embodiments of the systems and methods according to this invention include a self-similar planar fractal antenna such as a modified Sierpinski gasket antenna and MEMS switches of the ohmic contact cantilever type as will be described. The feature of self-similarity of a fractal antenna provides the basis for the multiple frequency antenna herein. The antenna has the advantage of radiating similar patterns in a variety of frequency bands.

The following description is one possible implementation of the design but should not be considered the only possible implementation.

Referring first to FIGS. 1 through 4, an exemplary structure for a reconfigurable multifrequency antenna 100 is illustrated. In particular, the basis for the antenna 100 includes planar self-similar fractal antenna elements defining a Sierpinski configuration as shown. The reconfigurable antenna 100 is formed on a surface of substrate 300 and includes a DC voltage source 500 for selectively actuating a plurality of RF-MEMS switches 200. The switches 200 and the reconfigurable antenna 100 are formed on the same substrate 300 in order to properly connect the switches 200 as will be described.

The fractal (or self-similar) antenna 100 includes a repeating triangular structure forming a Sierpinski gasket on each antenna arm. The antenna 100 may therefore be characterized as the described "self-similar" configuration with opposing arms 120 on the configuration 100. Each arm 120 includes three triangular shaped antenna patches 130. The antenna patches 130 each include a base end 132 and a vertex 134 opposing the base end 132. The vertex 134 is joined to the base end 132 by sides 136 of the triangular antenna patch 130. As will be apparent from the figures, base ends 132 of two antenna patches 130 define an outer end 122 of each antenna arm 120 and the vertex 134 of the remaining antenna patch 130 defines an inner angle 124 of the wing 120. As such, the vertexes 134 of the outer end antenna patches 130 align with corners of the base end 132 of the remaining antenna patch 130. Further, sides 136 of the triangular antenna patches 130 define common sides 126 of an overall antenna arm 120 as shown. The overall arm 120 defines a triangle as distinguished by a Sierpinski gasket antenna pattern. Opposing arms 120 are identical in structure and exhibit common characteristics as will be further described.

The individual antenna patches 130 are connected by the switch 200 at the vertexes 132 of the antenna patches aligned with the base end corners of the remaining triangular antenna patch 130. Accordingly, two switches 200 are provided on each arm 120 of the antenna 100.

It will be apparent that the radiation patterns of an antenna are inherently related to the distributions of the currents on its surface. By predetermining these current paths, the anitenna's radiation patterns can be defined at various frequencies of operation. By selectively actuating the individual switches 200, a desired frequency may be obtained for the antenna 100. In addition, the frequency will be further characterized based on the bow angle of the antenna configuration.

The switches 200 used herein are micro-electromagnetic switches (MEMS). The MEMS switches exhibit good radio frequency (RF) characteristics and can be used in both low and high frequency applications.

The switches 200 are arranged such that a single switch 200 is positioned at the vertex 134 of the two outermost antenna patches 130 to connect to base corners of the inner antenna patch 130 and thereby defining a Sierpinski gasket structure with connected triangular patches, as shown particularly in FIG. 1. The positioning of the four switches 200 permits a physical connection and disconnection of individual antenna patches 130 or sections of the antenna's conductive parts relative to each other. It will be apparent that the reconfigurable antenna 100 may be reconfigured in both symmetric and asymmetric designs.

The switches 200 enable either a bow-tie mode of operation in which all switches 200 are OFF, and a MEMS-enabled (or fractal) mode of operation in which all switches are ON. Since the fractal mode has an active (connected, interconnected or activated) structure consisting of the single-iteration Sierpinski gasket, two widely spaced resonant frequencies will result.

In an exemplary embodiment, when all switches 200 are OFF, the antenna 100 resonates at a first frequency of, for example 14 GHz, behaving as a bow-tie antenna. When all switches are ON, the antenna 100 resonates at two different frequencies of, for example 8 GHz and 23 GHz. These resonant frequencies are a result of the self-similar Sierpinski gasket fractal antenna configuration that is formed when all switches are ON.

It will be understood that two other non-symmetrical configurations may be obtained by setting one switch ON and one switch OFF on each arm 120 of the antenna 100. The result is a total of four different paths for the currents to flow and therefore generates four possible antenna configurations. However, those switching connections generating non-similar radiating patterns with respect to the previously mentioned configurations, at their higher frequency resonances, are outside the scope of the present invention. Instead, it will be appreciated that the self-similarity between the two major modes of "bow-tie" and "fractal" results in similar radiation patterns which are of most importance to the present multi-band invention.

Still further, an angle of the bow-tie antenna configuration contributes to the antenna radiating at a selected frequency. In an exemplary embodiment, a bow angle less than 90° gave satisfactory input impedance (close to 50Ω) and bandwidth for the OFF configuration. Also, a bow angle from about 35° to 60° gave satisfactory input impedance and bandwidth for both resonance frequencies of the switches ON configuration. By varying the bow angle, different input impedances can be obtained. An input impedance of about 50Ω is desired for all frequencies of interest. Also, considerable bandwidth is wanted to facilitate communications. The angle affects the bandwidth as well. Angles have been chosen where the impedance is about 50Ω and good bandwidth is observed.

According to an exemplary embodiment as shown in FIGS. 2 and 3, further details of the switches 200 are explained. The RF-MEMS switches 200 herein are formed on the substrate 300 such as, for example, a silicon substrate. The switch 200 includes an electrostatically actuated suspension membrane or cantilever 220 positioned above a biasing pull down electrode 230. The pull down electrode 230 is overlaid with a dielectric material 240 such as silicon nitride. The input of the RF signal is denoted by RF IN 250 and the output of the RF signal is denoted with RF OUT 260 in FIG. 2, and are considered to be on the same metal layer with the antenna patches. High-resistive biasing lines 400, 410, and 420 connect the switch 200 to corresponding DC biasing pads 402, 412, and 422, respectively. The biasing pads 402, 412, and 422 can also be placed several wavelengths from the antenna 100 in order to mitigate any interference with the antenna's radiation.

The biasing voltage is a function of the area of the cantilevers 220 that is directly above the pull down (biasing) electrode 230, the distance of the cantilever 220 from the electrode 230 when the cantilever 220 is up, the relative permittivity of the dielectric material 240 between the cantilever 220 and the electrode 230, and the flexibility and thickness of the membrane material defining the cantilever 220. Switching times of 5-30 μs have been achieved. The biasing voltage determines the minimum distance between the biasing lines 400, 410, and 420 according to the breakdown voltage of the substrate material 300.

In accordance with various embodiments, the biasing lines 400, 410, and 420 are placed at a distance that withstands more than five times higher voltage than the actual voltage applied by DC voltage source 500.

As indicated, each switch 200 is fabricated on the substrate 300, such as a silicon wafer. The silicon substrate 300 may be, for example, a 400 μm thick, high-resistivity (p>10 KΩ-sq) silicon wafer. The cantilevered flexible membrane 220 is suspended about 2 μm above the bottom pull down electrode 230. The pull down electrode 230 is further connected to a DC probe pad (not shown) after its corresponding high-resistive line such that electrostatic biasing occurs on demand by applying a DC voltage of approximately 40 Volts to the DC probe pad. The switch 200 performs in the exemplary antenna applications for frequencies up to 40 GHz.

Accuracy of an applied potential difference to the switch 200 is ensured by grounding the other two biasing lines Bias 1 (410) and Bias 2 (420) in addition to the bias line Bias 0 (400) where the DC voltage to the switch 200 is applied. The bias lines 400, 410, 420 are connected to the switch 200 as shown in FIG. 4. The DC biasing pads 402, 412, 422 for each switch 200 are placed about 2500 μm away from the outermost conductive part of the antenna 100, to minimize the deformation of the radiation pattern caused by the metallic surface of the probe chucks used for measurement (not shown).

The bias lines 400, 410, 420 are conductive and selection of the metal for the bias lines therefore affects the antenna's behavior. Accordingly, the present invention utilizes a high-resistive material for the metallic bias lines. For example, the conductive material of the bias lines can be Aluminum-deposited Zinc Oxide (AZO) deposited by a combustion chemical vapor deposition procedure. Even further, the DC bias lines may consist of two different materials including the highly resistive AZO and a thin layer of conductive metal in connection with the DC probe pads. The thin layer of conductive metal may be gold. The highly resistive bias lines are applied with a chemical etching process while the conductive thin layer of gold is applied with a lift off process.

The bias lines 400, 410, 420 are positioned to pass close to the antenna and parallel to its sides (edges) as shown in the biasing network of FIG. 4. In this manner, if any energy is radiated from the bias lines 400, 410, 420 or coupled to the bias lines, the energy will, most likely, constructively interfere with the antenna's radiation pattern and so it will not deteriorate the antenna's performance. The use of high-resistive materials for the metallic bias lines overcomes any potential increase of the currents surface density at the points where the bias lines 400, 410, and 420 connect to the switch 200. Thus, deformation of the antenna's radiation pattern is minimal and the slight extension of the currents' path causes only a slight shift in the resonant frequencies.

Selective actuation of the switches 200 enables two different symmetric antenna configurations with each of the three resonant frequencies demonstrating a similar radiation pattern. In an exemplary embodiment of the antenna 100 and at a state defined by all switches OFF, a first band of 14 GHz is achieved. At a state defined by all switches ON, a second band of 8 GHz and a third band of 23 GHz can be achieved.

The DC pads are both of 150 μm and 400 μm pitch for measurement purposes. Further, the DC bias is applied from the top and bottom of the antenna, while the RF is applied from the side of the antenna.

In order to feed the antenna 100, a balanced typed of feed that will set the voltage on its terminals to a 180° phase-difference is used. The antenna is fed with the RF probe through a coplanar waveguide (CPW) to coplanar stripline (CPS) transition. The transition maintains a 50Ω characteristic impedance and ends in the pads with 150 μm pitch. The RF feed line is fabricated on the same substrate as the antenna and enables the measurement of the antenna's performance using the available RF probes. Details of the transition are outside the scope of the present embodiments and will not be discussed further herein.

Another feature of the exemplary embodiments resides in the deposition and patterning of the thin layer of the silicon nitride dielectric material in connection with the switch. It will be appreciated that the thickness, smoothness, and uniformity of the layer should be well controlled to provide a good isolation layer between the cantilever membrane 220 and the pull-down electrode 230 of the MEMS switches 200.

Figure 5:
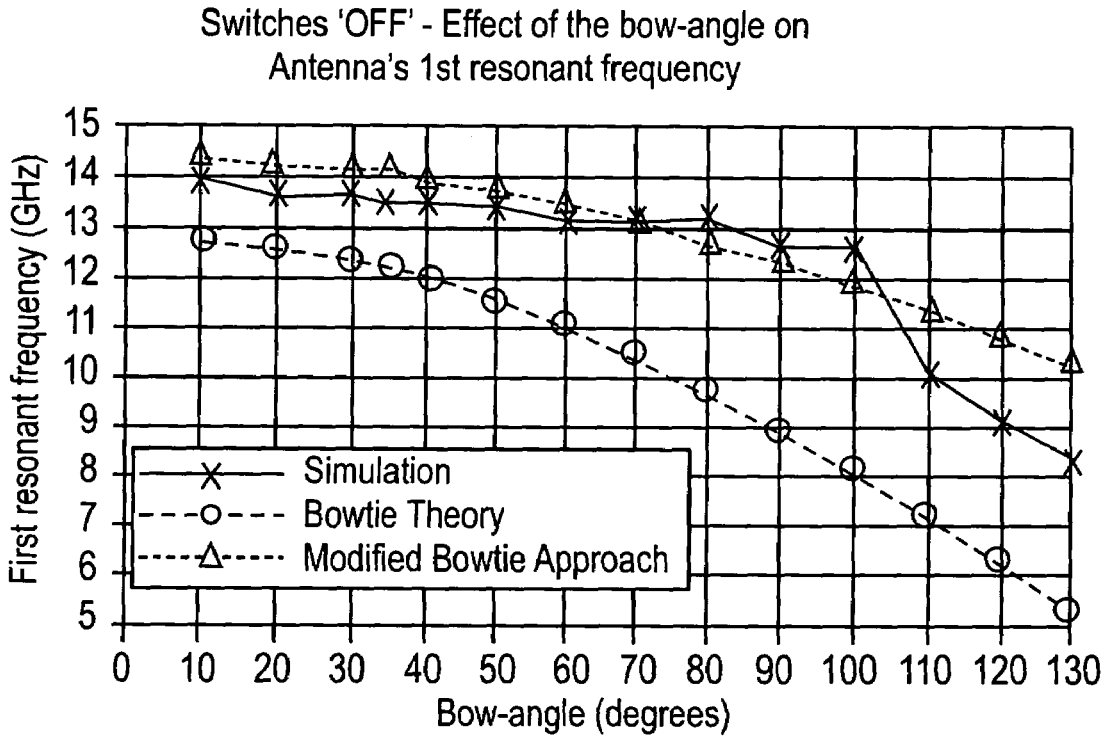
FIG. 5 is graph illustrating an effect of a bow-angle with all switches OFF on an antennas first resonant frequency in connection with the exemplary antenna.
Figure 6:
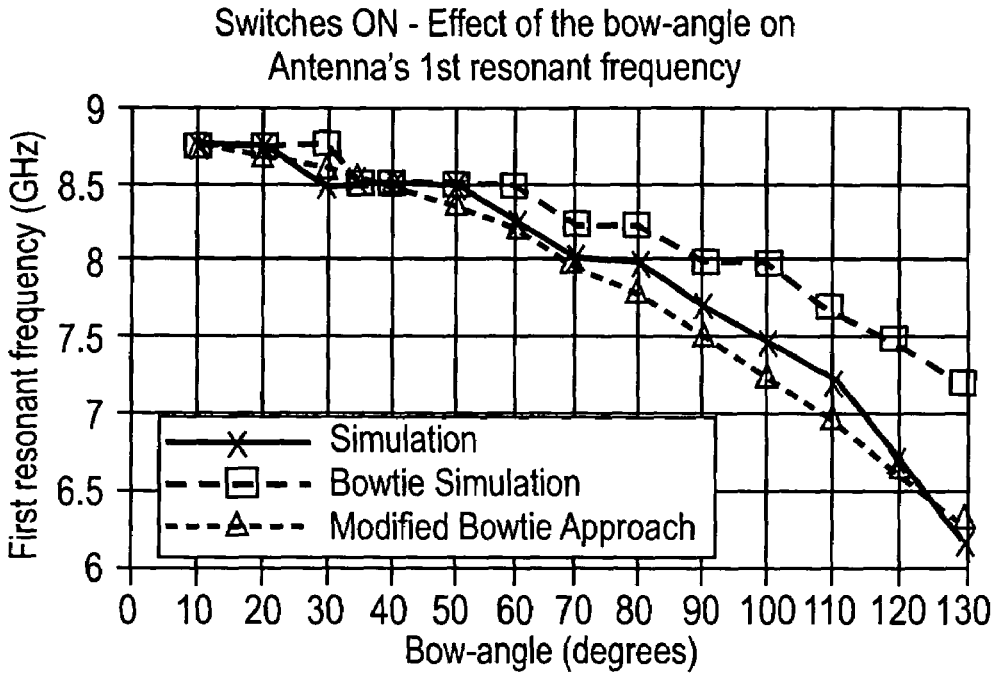
FIG. 6 is a graph illustrating an effect of a bow-angle with all switches ON for a first resonant frequency of an antenna in connection with the exemplary antenna.
Figure 7:
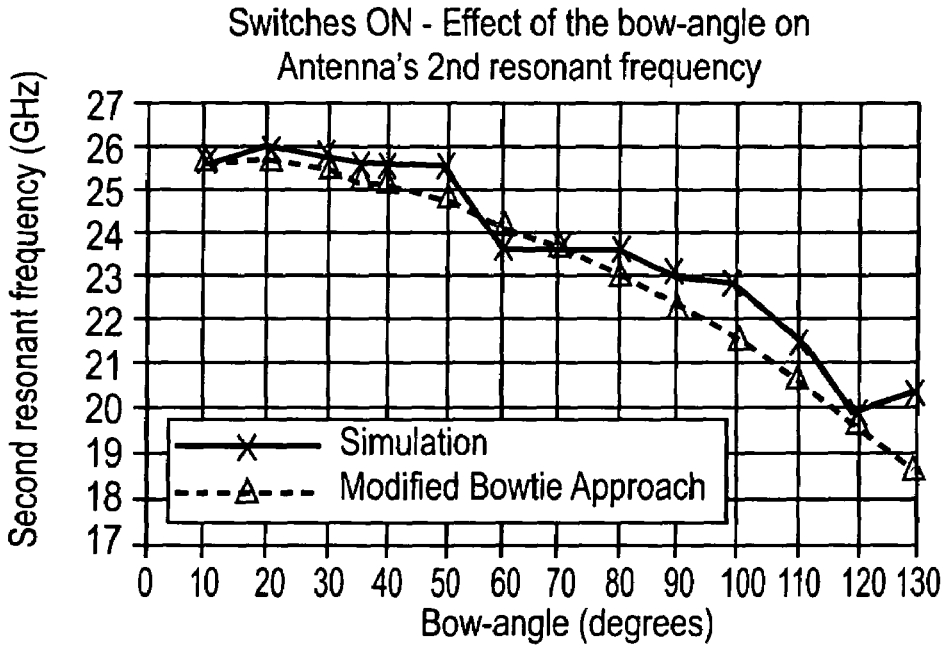
FIG. 7 is a graph illustrating an effect of a bow-angle with all switches ON for a second resonant frequency of an antenna in connection with the exemplary antenna.

Referring now to FIGS. 5 through 7, graphs are provided to further illustrate an effect of the bow angle of the antenna when all switches 200 are OFF or ON. From FIG. 5 (switches OFF), it can be seen that the resonant frequency diverges more and more for wider bow-angles from a predicted one when the antenna is placed on a dielectric half-space. This means that the capacitive coupling is greater for wider angles and thus increases the antenna's effective surface.

From FIG. 6 and all switches ON, it can be seen that as the bow angle becomes larger, the self-similar antenna resonates at increasingly lower frequencies and thus its active area becomes slightly larger. This suggests that capacitive coupling between the triangles increases, and additional parts of the structure radiate causing the active area to enlarge. At the same time, the triangular gap in the structure defines different current paths on the antenna, and practically reduces its effective area and thus it increases the antenna's resonant frequency.

From FIG. 7 and all switches ON, it can be seen that the antenna resonates at a frequency almost one and a half times higher than with all switches OFF.

Figure 8:
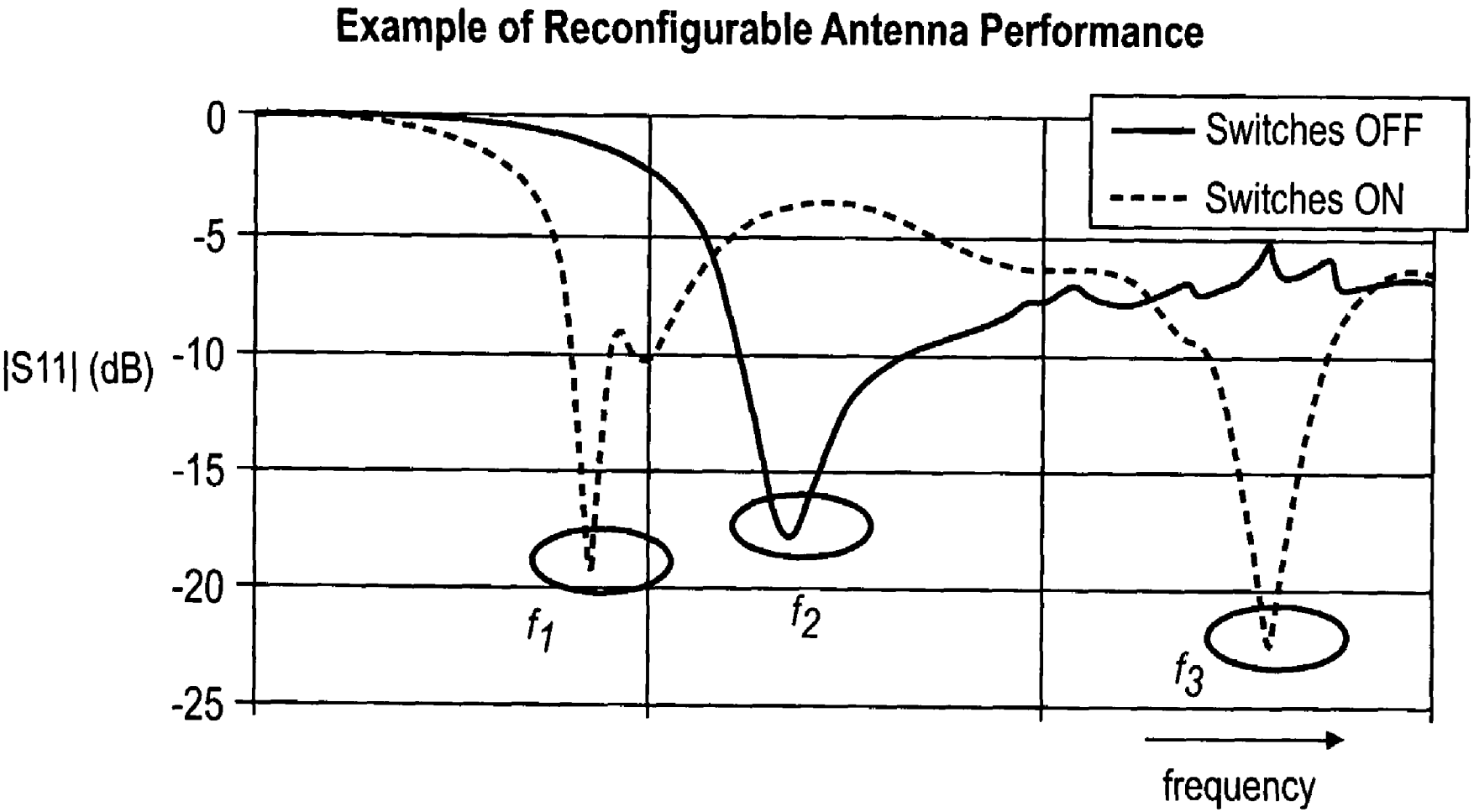
FIG. 8 illustrates an example of reconfigurable antenna performance.

FIG. 8 illustrates an example of reconfigurable antenna performance. The antenna is designed to resonate at three different frequencies, labeled as $f_1$, $f_2$, and $f_3$. Two of the frequencies, $f_1$ and $f_3$ occur when all switches are ON, and the remaining frequency $f_2$ occurs when all switches are OFF. It will be apparent that the frequencies increase from $f_1$ to $f_3$ and are distinctly spaced. The representative visualization illustrates that the maximum effect of the bias lines on the antenna's performance occurs at the higher frequencies.

While the invention has been illustrated with respect to one or more exemplary embodiments, alterations and/or modifications can be made to illustrated examples without departing form the spirit and scope of the appended claims. In addition, while a particular feature of the invention may have been disclosed with respect to only one of several embodiments such feature may be combined with one or more other features of the other embodiments as may be desired and advantageous for any given or particular function. Furthermore, to the extent that the terms "including", "includes", "having", "has", "with", or variants thereof are used in either the detailed description and the claims, such terms are intended to be inclusive in a manner similar to the term "comprising." And as used herein, the term "one or more of" with respect to a listing of items such as, for example, "one or more of A and B," means A alone, B alone, or A and B.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A reconfigurable antenna comprising:

a substrate;

a metallic antenna patch structure formed on a surface of said substrate, said antenna structure including symmetrically opposed fractal geometry antenna patches defining a reconfigurable self-similar configuration;

switches operatively connecting adjacent antenna patches on each arm of the self-similar configuration;

a DC voltage source for selectively actuating said switches; and a plurality of bias lines electrically coupled to the DC voltage source and at least one of the switches, the plurality of bias lines comprising bias line portions which are parallel to each other and to an adjacent antenna patch edge to constructively interfere with the antenna's radiation pattern during operation.

2. The antenna according to claim 1, wherein the self-similar antenna configuration comprises a Sierpinski gasket pattern, wherein the bias line portions are parallel to an edge of a triangular Sierpinski gasket pattern patch.

3. The antenna according to claim 1, wherein said switches comprise four cantilever ohmic contact RF-MEMS switches.

4. The antenna according to claim 1, wherein selective actuation of said switches enables up to four different antenna configurations each comprising different resonant frequencies, and wherein each resonance frequency demonstrates a similar radiation pattern for ON and OFF configurations and for the first resonant frequency of asymmetric configurations.

5. The antenna according to claim 1, wherein electrostatic biasing in said switches occurs on demand by applying a DC voltage of about 40 Volts to said switch.

6. The antenna according to claim 1, wherein said switches each include two biasing lines providing a DC ground to said switch, a third biasing line connected to the switches pull-down electrode pad providing a DC voltage to the pad and thus actuating the switch, and a DC contact pad for each biasing line.

7. The antenna according to claim 6, wherein parts of said biasing lines comprise a high-resistive material.

8. The antenna according to claim 7, wherein said high-resistive material is aluminum-deposited zinc oxide (AZO) deposited with combustion chemical vapor deposition for a silicon substrate.

9. The antenna according to claim 1, wherein each triangular arm of the self-similar configuration includes a bow angle defined by an interior angle of the triangular arm and wherein the bow angle corresponds to a different input impedance, bandwidth, and resonant frequency of said antenna.

10. The antenna according to claim 9, wherein the bow angle is from about 10° to about 90°.

11. The antenna according to claim 9, wherein the bow angle is from about 20° to about 80°.

12. The antenna according to claim 9, wherein the bow angle is from about 50° to about 80°.

13. The antenna according to claim 9, wherein the bow angle is from about 10° to about 50°.

14. The antenna according to claim 9, wherein the bow angle is about 35°.

15. The antenna according to claim 9, wherein a resonance frequency of said antenna is about 8 GHz at a bow angle of between about 20° to about 80°.

16. The antenna according to claim 9, wherein a resonance frequency of said antenna is about 14 &Hz at a bow angle of between about 10° to about 90°.

17. The antenna according to claim 9, wherein a resonance frequency of said antenna is about 24 GHz at a bow angle of between about 10° to about 45° and about 50° to about 80°.

18. The antenna according to claim 1, wherein said antenna is fabricated monolithically with said switches on a common substrate comprising a 400 μm high-resistivity silicon wafer.

19. The antenna according to claim 1, wherein each cantilever of the switches and said antenna pattern comprise a flexible gold membrane.

20. The antenna according to claim 1, wherein said antenna performs at frequencies up to about 40 GHz according to performance of the switches.

21. A method for fabricating an RF-MEMS-based self-similar reconfigurable antenna comprising:

forming a substrate of a high resistivity material;

forming an antenna structure on a surface of said substrate, said antenna structure including symmetrically opposed triangular antenna patches defining a self-similar antenna configuration;

operatively connecting adjacent antenna patches on each arm of the self-similar configuration with an RF-MEMS switch using a plurality of bias lines electrically coupled to a power source, wherein the plurality of bias lines are formed to comprise bias line portions which are parallel to each other and to an edge of one of the triangular antenna patches to constructively interfere with the antenna's radiation pattern during operation; and selectively actuating said switches with the power source, wherein the power source outputs of about 40 Volts.

22. The method according to claim 21, wherein said switches comprise four cantilever ohmic contact RF-MEMS switches.

23. The method according to claim 21, wherein selective actuation of said switches enables at least four different antenna configurations each comprising different resonant frequencies, and wherein each resonance frequency demonstrates a similar radiation pattern.

24. The method according to claim 21, wherein said switches each include two biasing lines providing a DC ground to said switch, a third biasing line connected to the switches pull-down electrode pad providing a DC voltage to the pad and thus actuating the switch.

25. The method according to claim 24, wherein said biasing lines comprise a high-resistive material of aluminum-deposited zinc oxide (AZO) deposited with combustion chemical vapor deposition.

26. The method according to claim 21, wherein each triangular arm of the self-similar configuration includes a bow angle defined by an interior angle of the triangular arm and wherein the bow angle determines the input impedance, bandwidth and slightly shifts the resonant frequency of said antenna.

27. The method according to claim 26, wherein the bow angle is selected from any of about 10° to about 90°, about 10° to about 40°, about 20° to about 80°, about 50° to about 80°, and about 10° to about 50°.

28. The method according to claim 26, wherein a resonance frequency of said antenna is about 8 GHz at a bow angle of between about 20° to about 80°.

29. The method according to claim 26, wherein a resonance frequency of said antenna is about 14 GHz at a bow angle of between about 10° to about 90°.

30. The method according to claim 26, wherein a resonance frequency of said antenna is about 24 GHz at a bow angle of between about 10° to about 45° and about 50° to about 80°.

31. The method according to claim 21, wherein said antenna is fabricated monolithically with said switches on a common substrate comprising a 400 μm high-resistivity silicon wafer.

32. The method according to claim 21, wherein each cantilever of the switches and said antenna pattern comprise a flexible gold membrane.

33. The method according to claim 21, wherein said antenna performs at frequencies up to about 40 GHz according to performance of the switches.

34. An apparatus formed to provide the functionality in accordance with the method of claim 21.

* * * * *

UNITED STATES PATENT AND TRADEMARK OFFICE

CERTIFICATE OF CORRECTION

PATENT NO. : 7,589,674 B2
APPLICATION NO. : 11/488142
DATED : September 15, 2009
INVENTOR(S) : Anagnostou et al.

It is certified that error appears in the above-identified patent and that said Letters Patent is hereby corrected as shown below:

On the Title Page

Item (75) Inventors should read: Dimitrios Anagnostou, Albuquerque, NM (US); Guizhen Zheng, Phoenix, AZ (US); Ioannis Papapolymerou, Decatur, GA (US); and Christos Christodoulou, Albuquerque, NM (US)

Item (73) Assignee should read: STC.UNM, Albuquerque, NM (US) and Georgia Tech Research Corporation Signed and Sealed this First Day of June, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,589,674 B2
APPLICATION NO. : 11/488142
DATED : September 15, 2009
INVENTOR(S) : Anagnostou et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 520 days.

Signed and Sealed this

Twenty-first Day of September, 2010

David J. Kappos

David J. Kappos
*Director of the United States Patent and Trademark Office*